US007916880B2

(12) United States Patent
Starnes et al.

(10) Patent No.: US 7,916,880 B2
(45) Date of Patent: Mar. 29, 2011

(54) TRANSDUCER

(75) Inventors: Mark Starnes, Huntingdon (GB); Steven Mark Hoyle, Huntingdon (GB); James John East, Huntingdon (GB); Neil Simon Owen, Huntingdon (GB)

(73) Assignee: New Transducers Limited, Huntingdon (GB)

( * ) Notice: Subject to any disclaimer, the term of this patent is extended or adjusted under 35 U.S.C. 154(b) by 981 days.

(21) Appl. No.: 11/630,789

(22) PCT Filed: Jun. 15, 2005

(86) PCT No.: PCT/GB2005/002381

§ 371 (c)(1), (2), (4) Date: May 21, 2007

(87) PCT Pub. No.: WO2006/003367

PCT Pub. Date: Jan. 12, 2006

(65) Prior Publication Data

US 2007/0263886 A1 Nov. 15, 2007

Related U.S. Application Data

(60) Provisional application No. 60/584,133, filed on Jul. 1, 2004.

(30) Foreign Application Priority Data

Jun. 30, 2004 (GB) ..... 0414652.8

(51) Int. Cl.
*H04R 25/00* (2006.01)

(52) U.S. Cl. ..... 381/190; 381/152

(58) Field of Classification Search ..... 381/152, 381/173, 186, 190, 386, 431
See application file for complete search history.

(56) References Cited

U.S. PATENT DOCUMENTS

| | | | | |
|---|---|---|---|---|
| 7,180,225 | B2 * | 2/2007 | Sashida et al. | 381/190 |
| 7,333,621 | B2 * | 2/2008 | Lun | 381/190 |

FOREIGN PATENT DOCUMENTS

| | | | |
|---|---|---|---|
| DE | 103 29 387 | B3 | 9/2004 |
| EP | 0 711 096 | A1 | 5/1996 |
| GB | 1 348 564 | | 3/1974 |
| GB | 1 367 487 | | 9/1974 |
| GB | 2 225 896 | A | 6/1990 |
| WO | WO 01/54450 | A2 | 7/2001 |
| WO | WO 02/21881 | A1 | 3/2002 |
| WO | WO 03/098964 | A2 | 11/2003 |
| WO | WO 2005/027571 | A1 | 3/2005 |

OTHER PUBLICATIONS

European Patent Office, Communication pursuant to Article 94(3) EPC, Examination Report, Application No. 05 752 009.0-1224,Jul. 1, 2009, Rijswijk, Netherlands.

* cited by examiner

*Primary Examiner* — Suhan Ni
(74) *Attorney, Agent, or Firm* — Roylance, Abrams, Berdo & Goodman, LLP; Alan I. Cantor

(57) ABSTRACT

An inertial force transducer having an operative frequency range comprises a resonant element having a frequency distribution of modes in the operative frequency range of the transducer and a coupler for mounting the resonant element to a site to which force is to be applied. The resonant element is a piezoelectric device comprising a layer of piezoelectric material and a substrate layer on the layer of piezoelectric material. The substrate layer has a region extending beyond the piezoelectric layer, with the coupler mounted to the extended region whereby the low frequency performance of the transducer is extended.

11 Claims, 3 Drawing Sheets

TRANSDUCER

CROSS-REFERENCE TO RELATED APPLICATIONS

This application claims the benefit of provisional application No. 60/584,133, filed Jul. 1, 2004.

TECHNICAL FIELD

The invention relates to force transducers or actuators, e.g. for applying bending wave energy to panel-form acoustic diaphragms to form loudspeakers. More particularly, the invention relates to force transducers or actuators of the kind described in International application No. WO 01/54450. Such devices are known as "distributed mode actuators" or by the initials "DMA".

BACKGROUND ART

It is known from WO 01/54450 to couple a DMA to a site to which force is to be applied by an off-centre coupling means, e.g. a stub. Furthermore, it is known from WO 01/54450 that the parameters of the DMA may be adjusted to enhance the modality of the DMA.

It would be desirable to provide an alternative method for changing the fundamental resonance of the transducer.

DISCLOSURE OF INVENTION

According to the invention there is provided an inertial force transducer having an operative frequency range and comprising a resonant element having a frequency distribution of modes in the operative frequency range of the transducer, the resonant element being a piezoelectric device and comprising a layer of piezoelectric material and a substrate layer on the layer of piezoelectric material, and coupling means for mounting the resonant element to a site to which force is to be applied, characterised in that the substrate layer has a region extending beyond the piezoelectric layer, with the coupling means mounted to the extended region whereby the low frequency performance of the transducer is extended.

In WO 01/54450, an off-centre coupling introduces the stiffness of the stub as a factor in determining the frequency of the fundamental resonant mode f0 of the transducer. By reducing the stiffness of the stub, the fundamental resonance f0 of the beam changes from being a pure function of beam bending, to a function of bending and translation since some of the bending now occurs in the stub.

In the present invention, extending the substrate of the resonant element reduces the stiffness of the coupling system to provide compliance, i.e. flexibility between the coupling means and resonant element. This compliance results in the fundamental resonance f0 of the transducer dropping. Hence the performance of the transducer is extended to a lower frequency.

Since compliance is provided by the extended vane, the complexity of the system may be reduced whilst preserving design flexibility. The bending stiffness of the coupling means is preferably greater than the bending stiffness of the extended region. The coupling means may be stiff and rigid. Similarly, the connection between the substrate layer and the coupling means may be rigid.

The coupling means may be vestigial, e.g. a controlled layer of adhesive or may be in the form of a stub. The connection may be vestigial e.g. adhesive layer.

The transducer is inertial, i.e. not-grounded to a frame or other support, and is free to vibrate outside the extended region. That is, the resonant element is free to bend and so generate a force via the inertia associated with accelerating and decelerating its own mass during vibration.

The resonant element may be generally rectangular or beam-like. The extended region of the substrate layer may be at one end of the rectangular or beam-like resonant element with maximum translation occurring at the opposed end.

The resonant element may be in the form of a piezoelectric bimorph in which the substrate layer is sandwiched between two layers of piezoelectric material. The substrate layer may be metallic, e.g. brass.

From another aspect, the invention is a loudspeaker comprising a force transducer or actuator as defined above.

From yet another aspect, the invention is an electronic device, e.g. a mobile telephone or cell-phone, comprising a loudspeaker as defined above.

BRIEF DESCRIPTION OF DRAWINGS

The invention is diagrammatically illustrated, by way of example, in the accompanying drawings, in which.

MODE(S) FOR CARRYING OUT THE INVENTION

Figure 1:
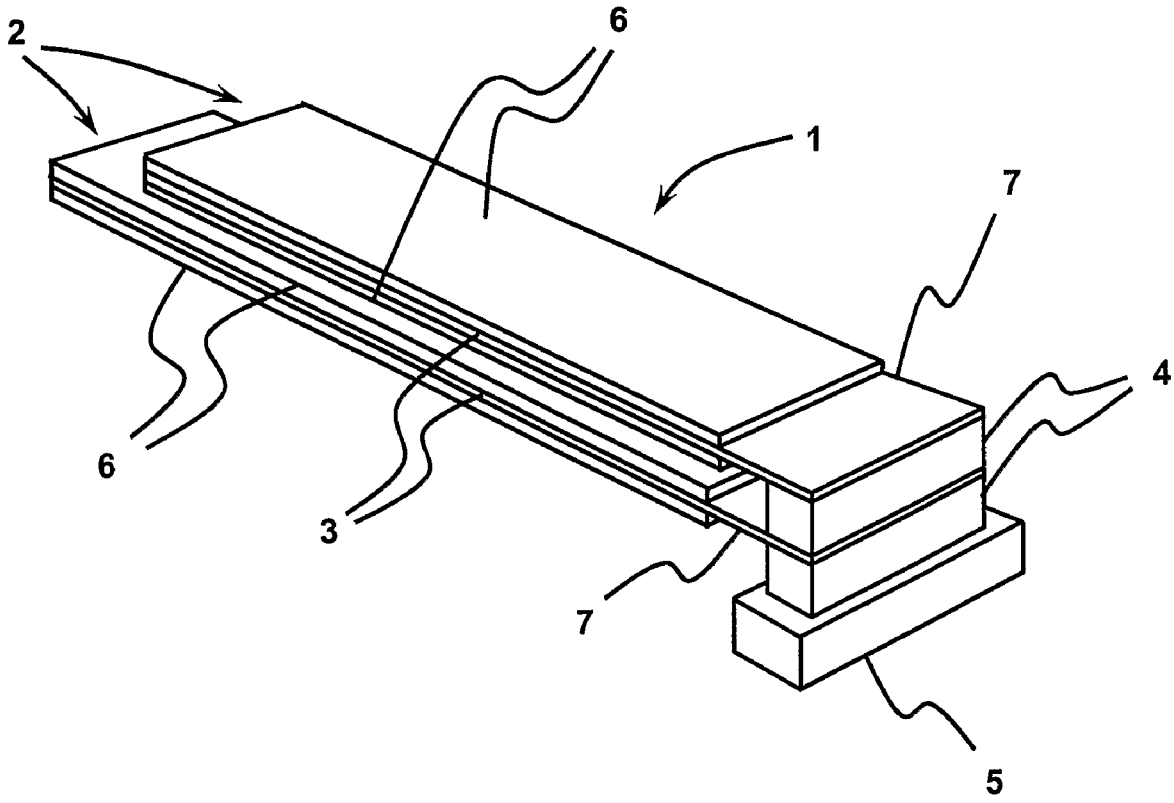
FIG. 1 is a perspective view of a force transducer or actuator according to the invention.
Figure 2:
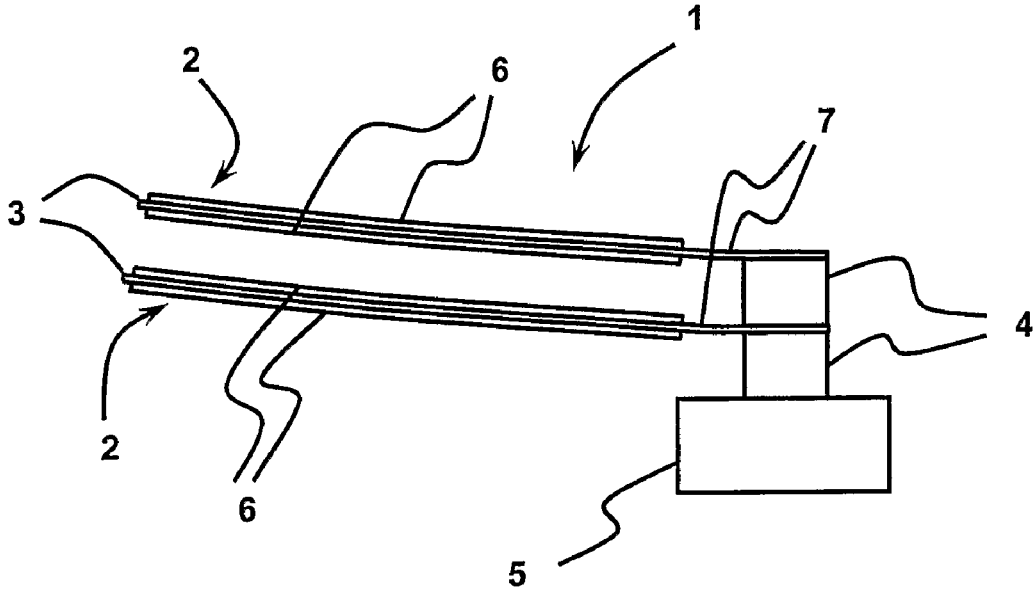
FIG. 2 is a side elevation of the transducer or actuator of FIG. 1.

FIGS. 1 and 2 show a force transducer 1 comprising two resonant elements in the form of piezo-electric bimorph beams 2. Each beam 2 comprises a central substrate layer in the form of a metallic, e.g. brass, vane 3 sandwiched between piezoelectric layers 6. At one end of each beam, the central vane 3 is extended to project beyond the piezoelectric layers 6 into an extended region 7.

The beams 2 are coupled via coupling means in the form of hard supporting stubs 4, where the bending stiffness of the stubs is greater than the bending stiffness of the vane, in the extended vane regions 7, e.g. by adhesive means. The stubs 4 are fixed by adhesive means to a site at which force is to be applied, in this case a blocked force jig 5. The jig 5 provides a mechanical ground, i.e. a mount position where there is a high mechanical impedance (>1000 Ns/m) resulting in effectively zero velocity at all frequencies of interest. In practical terms this is a metal block with a high mass (>1 kg) relative to the transducer.

FIG. 2 shows the displaced shape of the transducer at a frequency near the fundamental bending frequency f0. The opposed end of the transducer to the extended region is not attached to a frame or other support and is free to vibrate. The displacement of the transducer in a plane perpendicular to the plane of the transducer is greatest at this end. Nevertheless, most of the bending is occurring in the extended vane region 7.

Figure 3:
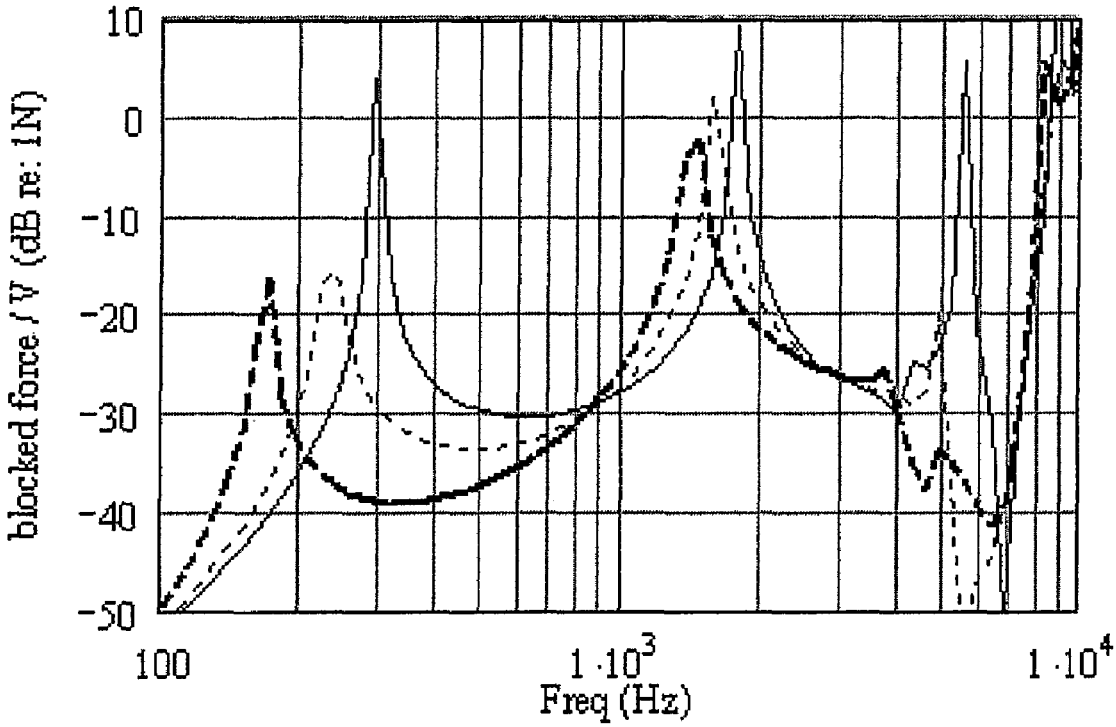
FIG. 3 is a graph of blocked force against frequency for varying lengths of extended region.

FIG. 3 shows the effect on blocked force of increasing the vane length between the end of the beam and the hard stubs. Only the vertical component of the force is presented and to reduce the errors contributed by noise and construction, a calibrated finite element model is used to demonstrate the effect. The solid line shows the effect of an unextended vane, the dotted line a extended region of length 0.5 mm and the dashed line a 1.5 mm extended region.

The frequency at which the lowest force peak occurs is reduced as the vane is extended, as does the magnitude at the trough. Extrapolating from the graph, the frequency of the peak may be reduced from 300 Hz to 200 Hz by using a 1 mm extended region, with a corresponding force reduction of 6.3 dBN.

The trough present in the 5 kHz region is only present for blocked force perpendicular to the beam plane. Examination of the component of blocked force in the direction parallel to the length of the beam shows no such behaviour. Accordingly, when the beam is mounted on a bending wave panel acoustic radiator, the trough at 5 kHz is not visible in the measured acoustic pressure.

The present invention provides a simple method of increasing the operating bandwidth of a DMA by increasing the length of the central vane beyond the end of the beam and bonding to the extension. However, there is a corresponding decrease in force output.

Figure 4:
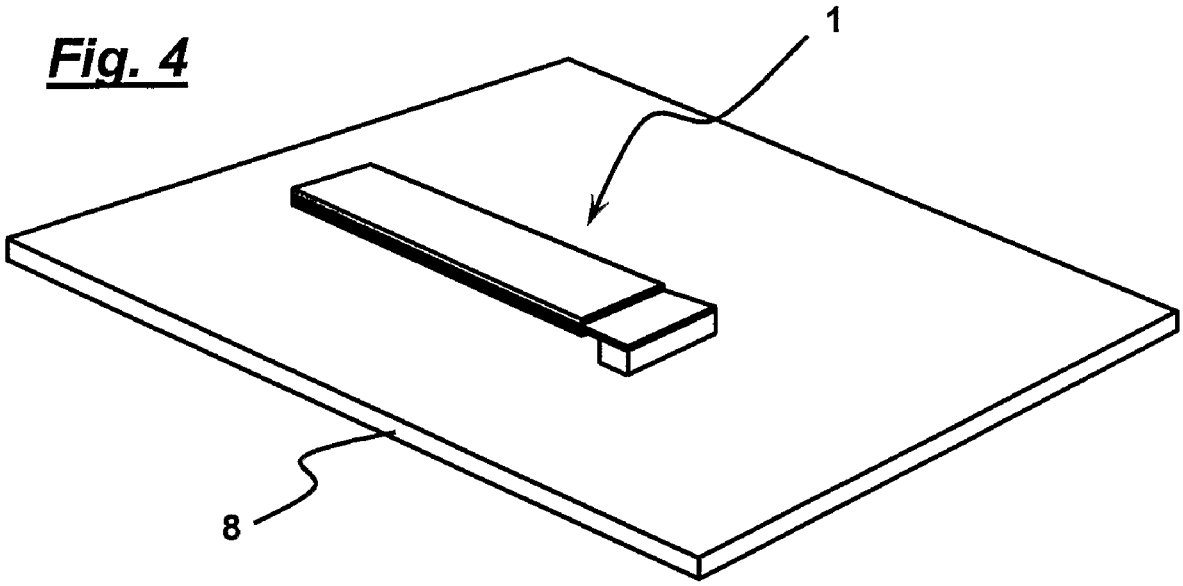
FIG. 4 is a perspective view of the transducer of FIG. 1 mounted to a diaphragm.

FIG. 4 shows a loudspeaker comprising a panel-form diaphragm 8 to which a transducer 1 as shown in FIG. 1 is mounted in an off-centre location. The transducer 1 excites bending wave vibration in the diaphragm whereby the diaphragm radiates to produce sound.

Figure 5:
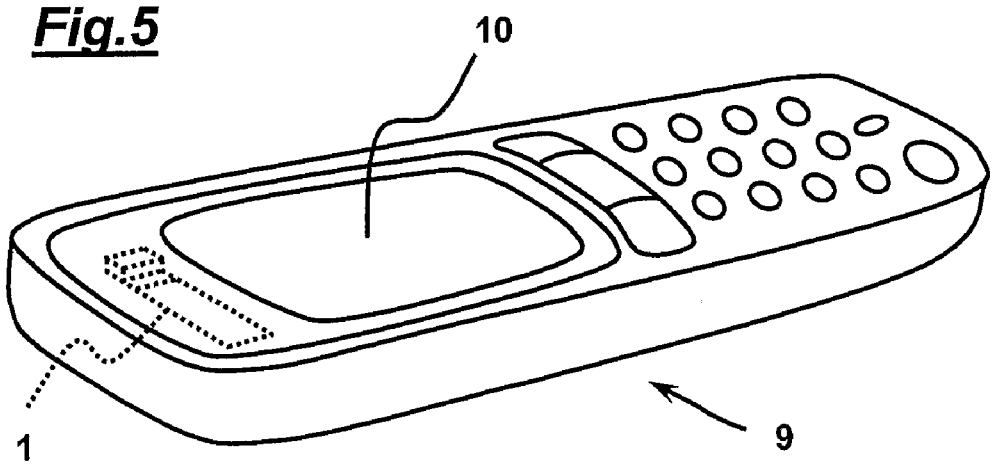
FIG. 5 is a perspective view of a mobile telephone incorporating the transducer of FIG. 1.

FIG. 5 shows a mobile phone 9 incorporating a loudspeaker similar to that shown in FIG. 4. The transducer 1 is mounted to the screen cover 10 at the side portion so as not to obscure the window though which the screen is visible.

The invention claimed is:

1. An inertial force transducer having an operative frequency range and comprising a resonant element having a frequency distribution of modes in the operative frequency range of the transducer, the resonant element being a piezoelectric device and comprising a layer of piezoelectric material and a substrate layer on the layer of piezoelectric material, and coupling means for mounting the resonant element to a site to which force is to be applied, characterised in that the substrate layer has a region extending beyond the piezoelectric layer, with the coupling means mounted to the extended region whereby the low frequency performance of the transducer is extended.

2. A force transducer accord to claim 1, wherein the parameters of the extended region are selected to enhance the modality of the resonant element.

3. A force transducer element is generally rectangular or beam-like and wherein the extended region of the substrate layer is one end of the resonant element.

4. A force transducer according to any preceding claim, wherein the bending stiffness of the coupling means is greater than the bending stiffness of the extended region.

5. A force transducer according to any preceding claim, wherein the substrate layer and the coupling means are coupled together with a rigid connection.

6. A force transducer according to any preceding claim, wherein the resonant element is a piezoelectric bimorph.

7. A force transducer according to any preceding claim, wherein the substrate layer is metallic.

8. A force transducer according to any preceding claim, comprising a plurality of resonant elements.

9. A loudspeaker comprising a force transducer as claimed in any preceding claim.

10. An electronic device comprising a loudspeaker as claimed in claim 9.

11. A mobile telephone or cell-phone comprising a loudspeaker as claimed in claim 10.

* * * * *